US006218636B1

(12) United States Patent
Blancfene et al.

(10) Patent No.: US 6,218,636 B1
(45) Date of Patent: Apr. 17, 2001

(54) SWITCHGEAR ARC EXTINGUISHING CHAMBER WITH SIDE WALLS MADE OF COMPOSITE MATERIAL

(75) Inventors: Marc Blancfene, Domessin; Marc Rival, Panissage, both of (FR)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/474,094

(22) Filed: Dec. 29, 1999

(30) Foreign Application Priority Data

Jan. 11, 1999 (FR) ..... 99 00344

(51) Int. Cl.[7] ..... H01H 33/02
(52) U.S. Cl. ..... 218/158; 218/150
(58) Field of Search ..... 218/34, 46, 85, 218/90, 103, 149, 150, 151, 155, 156, 157, 158

(56) References Cited

U.S. PATENT DOCUMENTS 3,956,447 5/1976 Denommee et al. ..... 364/135
4,733,032 3/1988 Pardini ..... 218/150
4,821,447 4/1989 Nakayama et al. ..... 43/18.1
5,475,193 * 12/1995 Perdoncin ..... 218/34
5,618,858 4/1997 Hauschildt et al. ..... 523/200
5,841,088 * 11/1998 Yamaguchi et al. ..... 218/158

* cited by examiner

*Primary Examiner*—J. R. Scott
(74) *Attorney, Agent, or Firm*—Parkhurst & Wendel, L.L.P.

(57) ABSTRACT

An electrical arc extinguishing chamber designed to be placed facing separable contacts of a switchgear apparatus and to extinguish the arc generated by separation of the contacts comprises two side walls facing one another and a plurality of spaced apart plates arranged between the side walls and secured by the side walls. The side walls have a stratified composite structure with at least two layers. The layers comprise a polyamide fabric impregnated with thermosetting resin. The chamber thus obtained has advantageous breaking strength properties. The edges of the side walls do not present any dielectric weakness points. The chamber is particularly suitable for low-voltage switchgear of high power ratings.

12 Claims, 7 Drawing Sheets

SWITCHGEAR ARC EXTINGUISHING CHAMBER WITH SIDE WALLS MADE OF COMPOSITE MATERIAL

BACKGROUND OF THE INVENTION

The invention relates to an arc extinguishing chamber whose side walls are made of composite material, and to a switchgear device comprising such a chamber.

Low-voltage circuit breakers of high ratings more often than not comprise separable contacts arranged at the entry of an arc extinguishing chamber. When separation of the contacts takes place caused by a trip device following an overcurrent, an electrical arc arises between the contacts and is propagated in an arc extinguishing chamber designed to absorb the energy of the arc while maintaining its voltage. The chamber comprises a plurality of separators arranged transversely to the arc and designed to break the arc down into fractions. This fractioning enables the voltage of the arc to be increased and the arc to be cooled by heat exchange with the separators. The separators are supported by two side walls of the chamber, arranged facing one another perpendicularly to the separators. These side walls essentially have to perform mechanical securing of the separators and electrical insulation.

The chamber is subjected to very high thermal, mechanical and electrical stresses: to give a good idea thereof, a current of 200,000 amperes maintained for 4 ms at an arcing voltage of 500 Volts gives off an energy of 400 kJ. The plasma column forming the arc can reach a temperature situated between 4,000 and 20,000 Kelvins. The separators are subjected to electrodynamic forces during breaking tending to separate them from one another. The pressure in the arc extinguishing chamber can at the same time reach 1.4 MPa.

The side walls have to withstand these stresses without becoming conducting themselves and without giving off a low dielectric strength gas.

Traditionally, the walls are formed by a stratified material composed of successive layers of thermosetting resin reinforced by fiber glass. The glass fibers give the walls their mechanical strength. However glass fibers contain low ionization potential elements. Experience shows that when these glass fibers are subjected to high temperatures, the elements having a low ionization potential inside the fibers ionize and hamper the arc extinguishing process, in particular for voltages in excess of 400 Volts. In addition, molten glass beads appear at the surface due to ablation of the resin and foster adhesion of metallic particles given off in the chamber by melting of the separators. The surface resistance of the walls, taken between two points both of which are close to one of the separated contacts, therefore decreases during breaking. For these reasons, the risk of breaking failure is high.

To overcome this problem, the document FR-2,616,009 proposes a three-layer composite stratified structure. The external layers are formed by a multitude of linen fibers impregnated with melamine resin whereas the internal layer is constituted by a multitude of woven glass fibers impregnated with melamine resin. The layer comprising the glass fibers gives the structure its rigidity whereas the superficial layer comprising linen fibers remains non-conducting even during and after exposure to the arc. This stratified material proves satisfactory in applications where it is only exposed to the arc on the side where its layer comprising linen fibers is situated. The material does on the other hand present some problems in an architecture requiring that an edge of the side wall be exposed to the arc. Such an architecture is for example encountered in the case of a circuit breaker comprising, for a given phase, two poles connected in parallel, each pole being provided with an arc extinguishing chamber, the arc extinguishing chambers being connected to one another by a communication orifice made in the adjacent side walls of the two chambers and enabling circulation of the gases. A circuit breaker of this type is described in the French Patent Application bearing the national registration number 98/06206. With such a cutting of the stratified material plate, the layer comprising glass fibers is flush with the surface of the edge, resulting in a certain vulnerablity in this zone. It is naturally possible to deposit an additional layer comprising linen fiber to specifically protect this zone, but this solution is costly.

It has moreover been proposed in the document DE-A-43 22 351 to replace the melamine-based thermosetting resins reinforced with cotton or linen cellulose fibers by a polyamide thermoplastic polymer matrix containing a cellulose material coated with a hardened melamine-formaldehyde resin, in which the polyamide and coated cellulose material are present in a ratio of 6:1 to 1:1. The material used is supposed to give dielectric properties at least equal to those of thermosetting materials, and better mechanical properties. However, experience shows that the thermoplastic nature of the material gives rise to problems from the temperature withstand point of view, in particular when progressive diffusion of the heat stored by the metallic separators takes place, during and after breaking, i.e. in practice about 30% of the breaking energy. As the polyamide of the walls tends to soften when the temperature rises, it undergoes deformations rapidly making the chamber unusable. This is why this solution is not applicable to circuit breakers with high ratings.

SUMMARY OF THE INVENTION

The object of the invention is therefore to overcome the shortcomings of the state of the technique in order to propose a high-performance structure of an arc extinguishing chamber side wall for low-voltage circuit breakers of high ratings producing arcing energies in the region of 400 kJ. Its object is in particular to determine such a structure whose edges are also resistant to breaking.

According to a first feature of the invention, this object is achieved by means of an electrical arc extinguishing chamber designed to be placed facing separable contact means of a switchgear apparatus and to extinguish the arc generated by separation of said contact means, comprising: two side walls facing one another, each side wall comprising a stratified composite structure with at least two layers, and a plurality of spaced apart plates arranged between the side walls and secured by the side walls, one of said layers comprising a polyamide fabric impregnated with a thermosetting resin. The resin is not simply disposed between two layers of fabric, but at least partially coats the fibers or wires constituting the fabric.

Each of the layers of the stratified composite structure preferably comprises a fabric of polyamide fibers at least partially coated with a thermosetting resin. The structure obtained is thus produced at low cost.

According to one embodiment the thermosetting resin is of the type obtained by condensation of formaldehyde with melamine.

Advantageously, the thermosetting resin contains fireproofing elements. Such a structure provides even better performances.

A second feature of the invention relates to a switchgear apparatus comprising a chamber as defined previously.

BRIEF DESCRIPTION OF THE DRAWINGS

Other advantages and features of the invention will become more clearly apparent from the following description of different embodiments of the invention, given as non-restrictive examples only and represented in the accompanying drawings in which.

DETAILED DESCRIPTION OF THE PREFERRED EMBODIMENT

Figure 1:
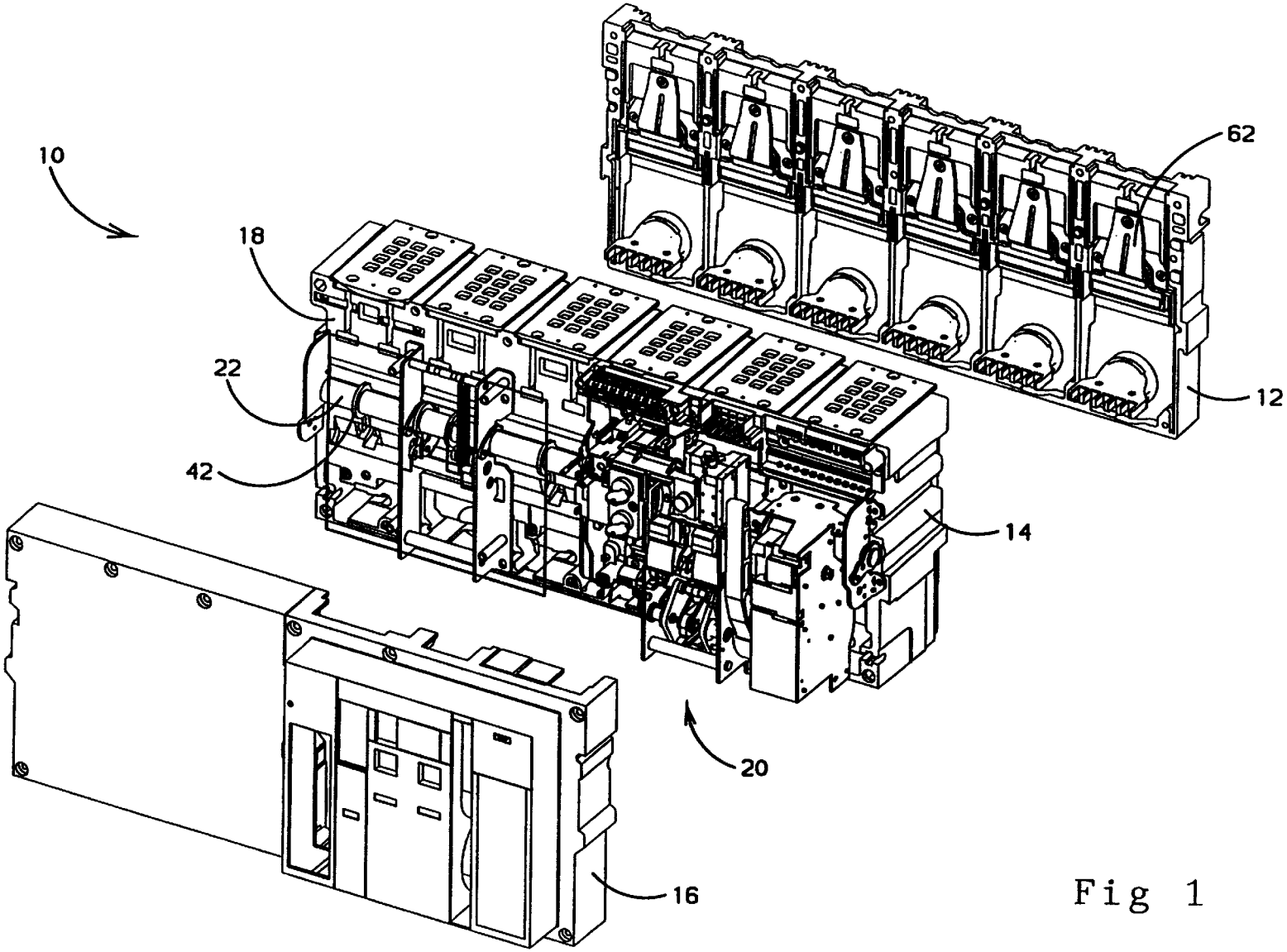
FIG. 1 represents an exploded perspective view of a circuit breaker according to the invention.
Figure 2:
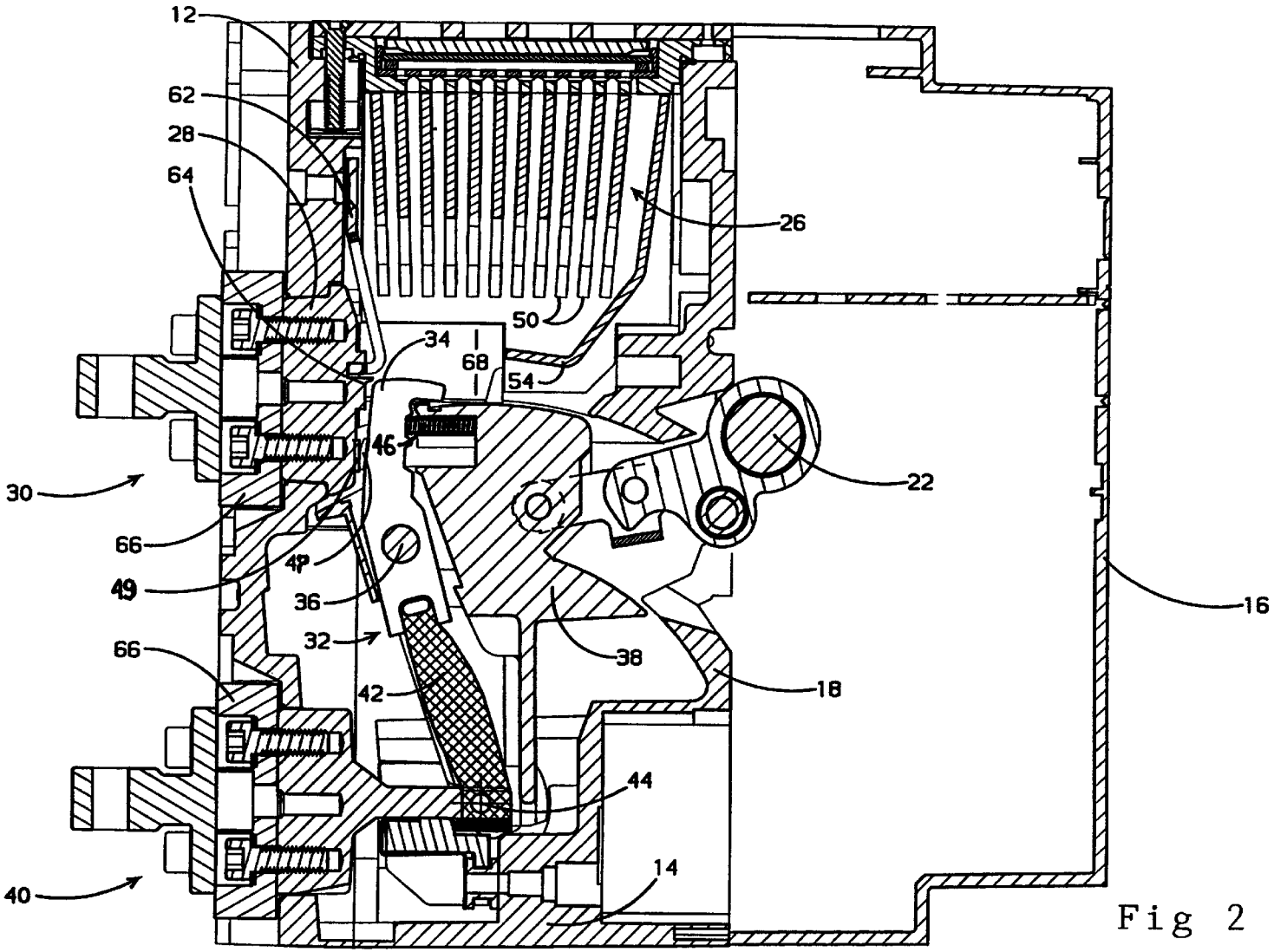
FIG. 2 represents a longitudinal cross-section of the circuit breaker of FIG. 1, along a mid-plane of the twinned pole of the circuit breaker.

With reference to FIGS. 1 and 2, a six-pole circuit breaker 10 comprises an insulating case formed by assembly of a rear base 12, an intermediate frame 14 with open ends and a front panel 16, which confine a rear compartment and a front compartment on each side of a front partition 18 of the intermediate frame 14. In the front compartment there is housed an operating mechanism 20 of the circuit breaker 10 which acts on a switching shaft 22 common to all the poles of the circuit breaker. This mechanism 20 is fitted on the front partition 18 of the intermediate frame 14. The rear compartment is itself subdivided into elementary compartments by intermediate partitions 24, 25 (cf. FIG. 4) of the intermediate frame 14. A pole of the circuit breaker is housed in each elementary compartment. Each pole comprises a separable contact device and an arc extinguishing chamber 26.

The separable contact device comprises a stationary contact means 28 directly supported by a first connection terminal 30 of the circuit breaker passing through the base 12 of the insulating case, and a movable contact means 32. The movable contact means 32 is provided with a plurality of parallel-mounted contact fingers 34 pivotally mounted on a first transverse spindle 36 of a support cage 38. The heel of each finger is connected to a second connection terminal 40 passing through the base 12, by means of a braided strip 42 of conducting material. The connection terminals 30, 40 are designed to be connected to the line-side and load-side power system, for example via a busbar. The end of the cage 38 situated near to the second connection terminal 40 is equipped with a spindle housed in a bearing securedly united to the insulating case, so as to allow pivoting of the cage 38 between an open position and a closed position of the pole around a geometric axis 44 materialized in FIG. 2. A contact pressure spring device 46 is arranged in a notch of the cage 38 and urges the contact fingers 34 to pivot counterclockwise around the first spindle 36. Each contact finger 34 comprises a contact pad 47 which, in the position represented in FIG. 2, is in contact with a single pad 49 arranged on the stationary contact means 28. The cage 38 is coupled to the switching shaft 22 by a transmission rod in such a way that rotation of the shaft 22 induces pivoting of the cage 38 around the spindle 44.

Figure 3:
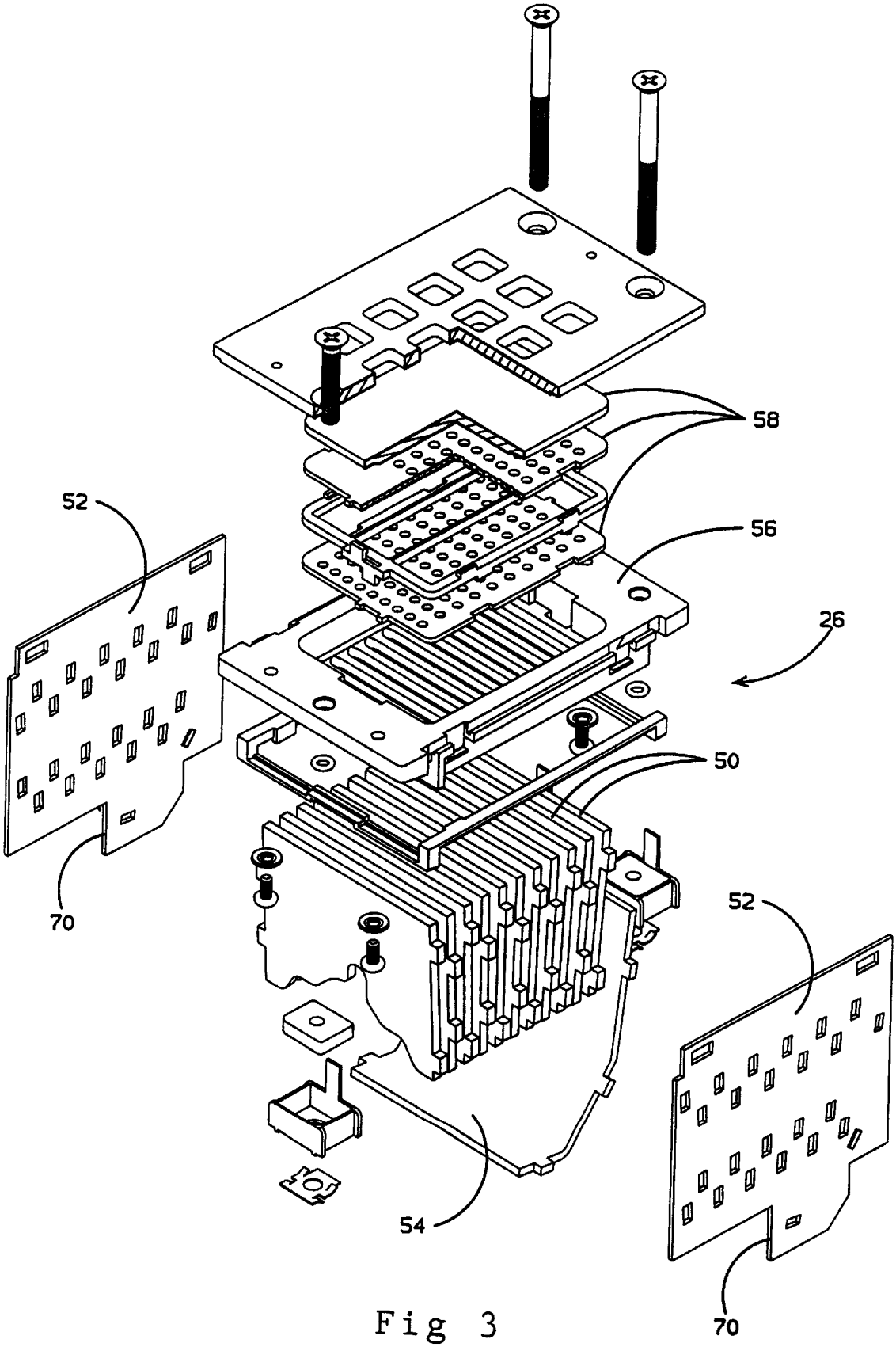
FIG. 3 represents an exploded view of an arc extinguishing chamber of a pole of the circuit breaker according to the invention.

The structure of the arc extinguishing chamber 26 can be seen more particularly in FIG. 3. The chamber comprises a juxtaposition of separators formed by metallic strips 50 for deionization of the electrical arc. The separators are assembled on an insulating support comprising two lateral cheeks 52. The internal face of each cheek 52 is provided with notches operating in conjunction with complementary asperities of the strips for positioning of the latter. Positioning of an upper arcing horn 54 is achieved in the same way. A composite external wall 56 is arranged appreciably perpendicularly to the lateral cheeks and to the deionization strips. This wall forms a frame for assembly of the lateral cheeks. It comprises exhaust orifices for outlet of the breaking gases and a stacking of intermediate filters 58 designed to limit pollution of the outside environment.

Figure 4:
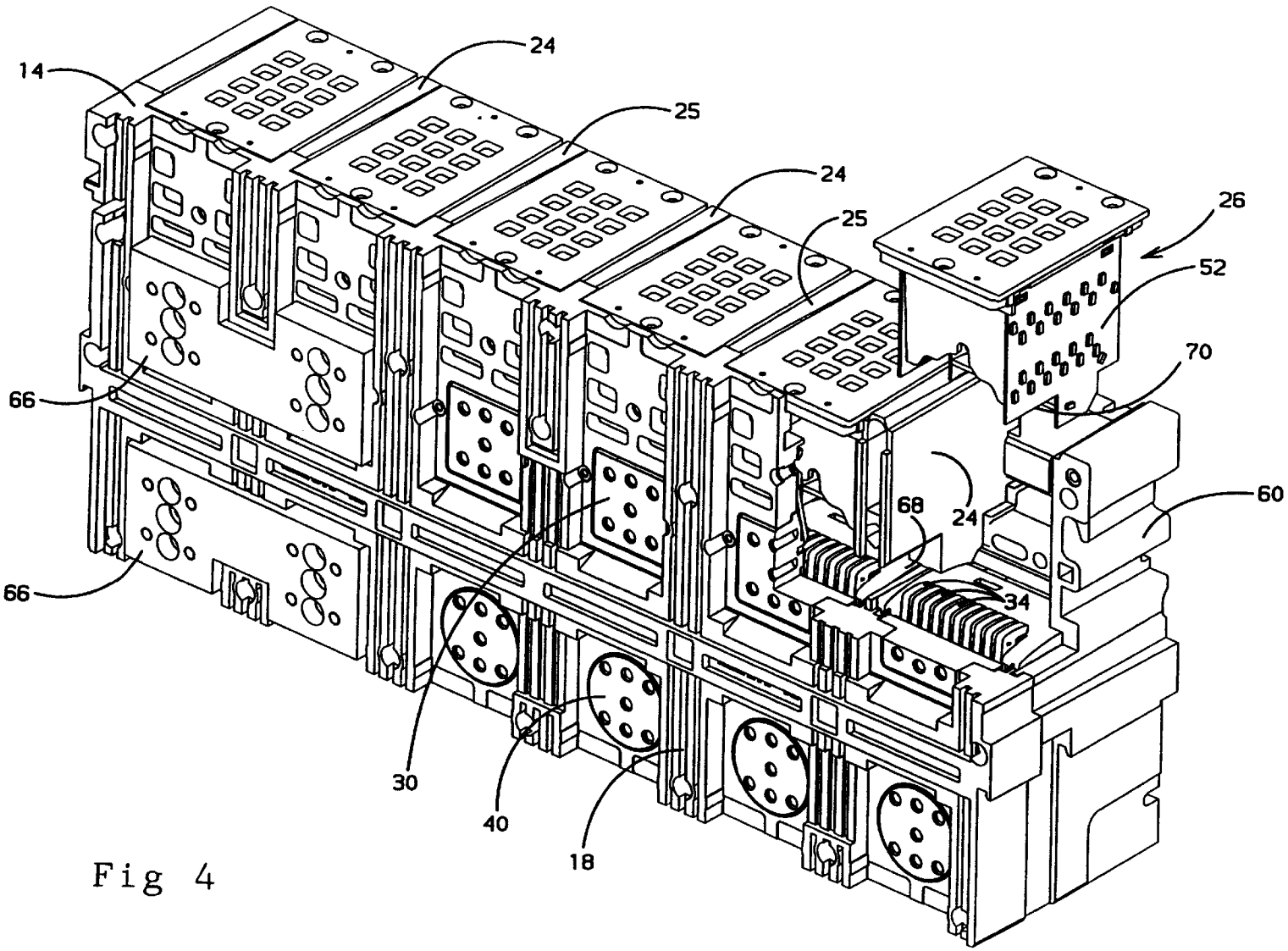
FIG. 4 represents a partially exploded perspective view of a rear compartment of the circuit breaker of FIG. 1, showing more particularly a communication orifice between two twinned poles according to the invention.

It can be seen in FIG. 4 how the arc extinguishing chamber 26 is inserted in one of the elementary compartments of the circuit breaker, here a lateral compartment bounded by an intermediate partition 24 and one of the external lateral partitions 60 of the intermediate frame 14. This construction enables the state of the circuit breaker poles to be checked and the arc extinguishing chamber 26 to be replaced with a reduced number of handling operations.

The extinguishing device is completed by a lower arc guiding horn 62 fixed to the base 12 and electrically connected to the stationary contact means 28 of the pole, which confines the inlet of the arc extinguishing chamber 26 in the downwards direction. The stationary contact 28 has, in the zone directly facing the front end of the fingers 34 of the movable contact means 32, a profiled edge 64 approximately complementary to the profile of the fingers 34, extending upwards to the protuberance of the lower horn 62 to globally form with the latter a profile without a notable break in the slope. This stationary contact zone, called spark arrester, enables the risks of damage to the contact pads 47 and 49 to be eliminated. When opening of the contact parts takes place, the initial pivoting movement of the cage 38 around its spindle 44—clockwise in FIG. 2—in fact causes pivoting of the movable fingers 34 around their spindle 36 in the opposite direction. In this initial phase, this combined movement results in the front part of the fingers and the spark arrester moving towards one another and coming into contact, before the contact pads 47, 49 separate. When separation of the pads 47, 49 takes place, the fingers 34 are in a position such that the distance between the pads 47, 49 increases more quickly than the distance between the lower horn 62 and the fingers 34 of the movable contact 32. Consequently the arc is initially drawn between the spark arrester and the front end of the fingers 34 and migrates immediately to establish itself between the protuberance of the horn 62 and the front part of the fingers 34, preventing any movement of the arc towards the pads 47, 49 or any striking at the level of the latter. When opening is pursued, the arc extends in front of the chamber and enters therein in the usual manner.

The poles of the circuit breaker 10 are twinned two by two so as to form three groups of two adjacent poles. By twinning we mean electrical connection in parallel of the stationary contact means 28 of the two poles and of the movable contact means 32 of the two poles. In practice, this twinning is performed outside the case, at the level of the free ends of the connection terminals 30, 40 of the contacts to be connected, by interposing two connection strips 66 which can be seen for one of the poles in FIG. 4, these two strips being fixed by each of their ends to a corresponding part of each connection terminal 30, 40 protruding out from the case.

Figure 5:
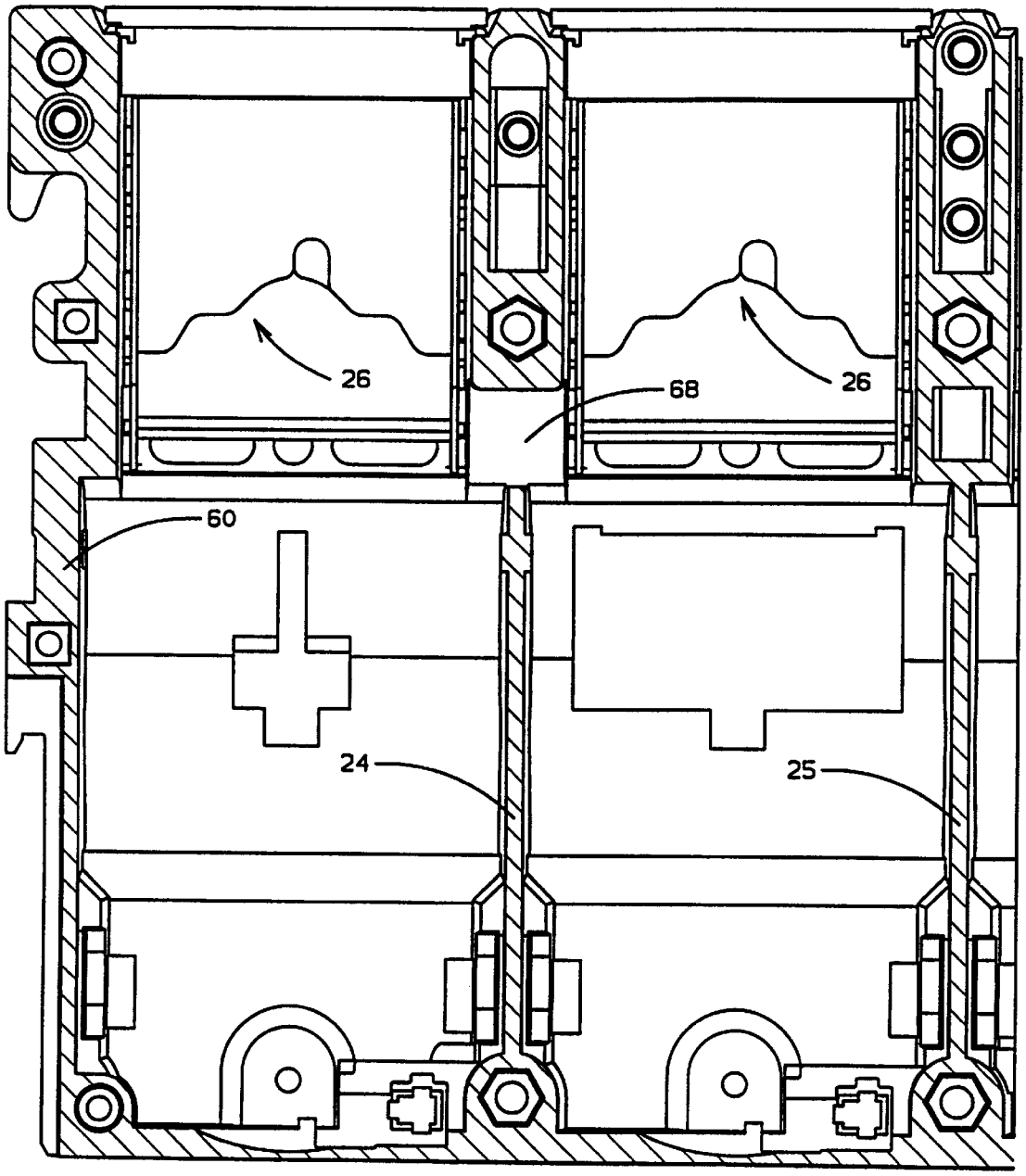
FIG. 5 represents a transverse cross-section showing two twinned poles.

The three intermediate partitions 24 separating two twinned compartments differ from the other two intermediate partitions 25 in that they comprise a communication aperture 68 of appreciably rectangular cross-section, as can be seen in FIGS. 2, 4 and 5. This aperture is situated close to the contact zone, at the level of the inlet to the arc extinguishing chamber. It is arranged in such a way that the lower arcing horns 62 of the two twinned poles are facing one another on each side of the aperture. In the heightwise direction, measured along an axis perpendicular to the base 12, the aperture 68 extends appreciably up to the height of the upper horns 54. In the lengthwise direction, measured along an axis perpendicular to the previous axis and to the pivoting spindle 44 of the movable contact means 32, the aperture extends on both sides of the inlet of the chamber 26. Finally, the inlets of the two arc extinguishing chambers 26 are practically not separated by the intermediate partition 24. An inlet opening common to the two arc extinguishing chambers 26 can thus be defined, which is materialized, in a straight cross-section perpendicular to the longitudinal axis, by an appreciably rectangular common orifice whose edge is defined following the edge of the upper horn 54 of one of the poles, the edge of the upper horn 54 of the twinned pole, a part of the wall of the intermediate partition 25 without aperture of this twinned pole, the protuberant upper edge of the lower horn 62 of the twinned pole, the corresponding edge of the lower horn 62 of the first pole and a part of the wall of the intermediate partition 25 without aperture—or of the external lateral partition 60, depending on the case—of the first pole. As can be seen particularly in FIGS. 2 to 4, the lateral cheeks 52 of the arc extinguishing chambers 26 have a cutout 70 corresponding to the aperture 68 of the intermediate wall 24 separating the twinned poles. The face of the lateral cheeks 52 of each arc extinguishing chamber 26 facing the adjacent intermediate partition 24, 25 is adjoined over its whole surface to the partition.

Figure 6:
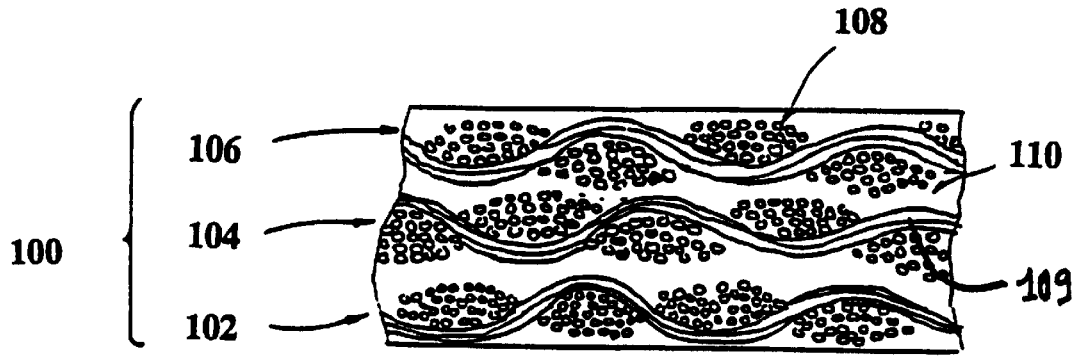
FIG. 6 represents a transverse cross-section of a side wall of a chamber according to FIG. 3.

Each lateral cheek 52 of the chamber 26 is formed by a structure 100 made of stratified composite material comprising three superposed layers 102, 104, 106, represented in FIG. 6. In this example, all the layers are identical and each composed of a polyamide fabric composed of weft wires or fibers 108 or warp wires or fibers 109 forming a cloth armor coated with a thermosetting resin 110 obtained by condensation of formaldehyde with melamine with a formula $C_3N_6H_6$. The fabric gives the structure its tensile strength. The resin gives the material its coherence and its compression resistance. It occupies not only the space between the different layers of cloth, but also the space between the wires of each layer of cloth, so that each wire is more or less coated with resin. In other words, each layer 102, 104, 106 is composed of a cloth impregnated with resin. The polyamide used can be a Pa 6 or Pa 6.6 polyamide. A stratified structure corresponding to these criteria is marketed by ITEN Industries (Ashtabula, Ohio, USA) under the reference "Resiten N-9".

Figure 7:
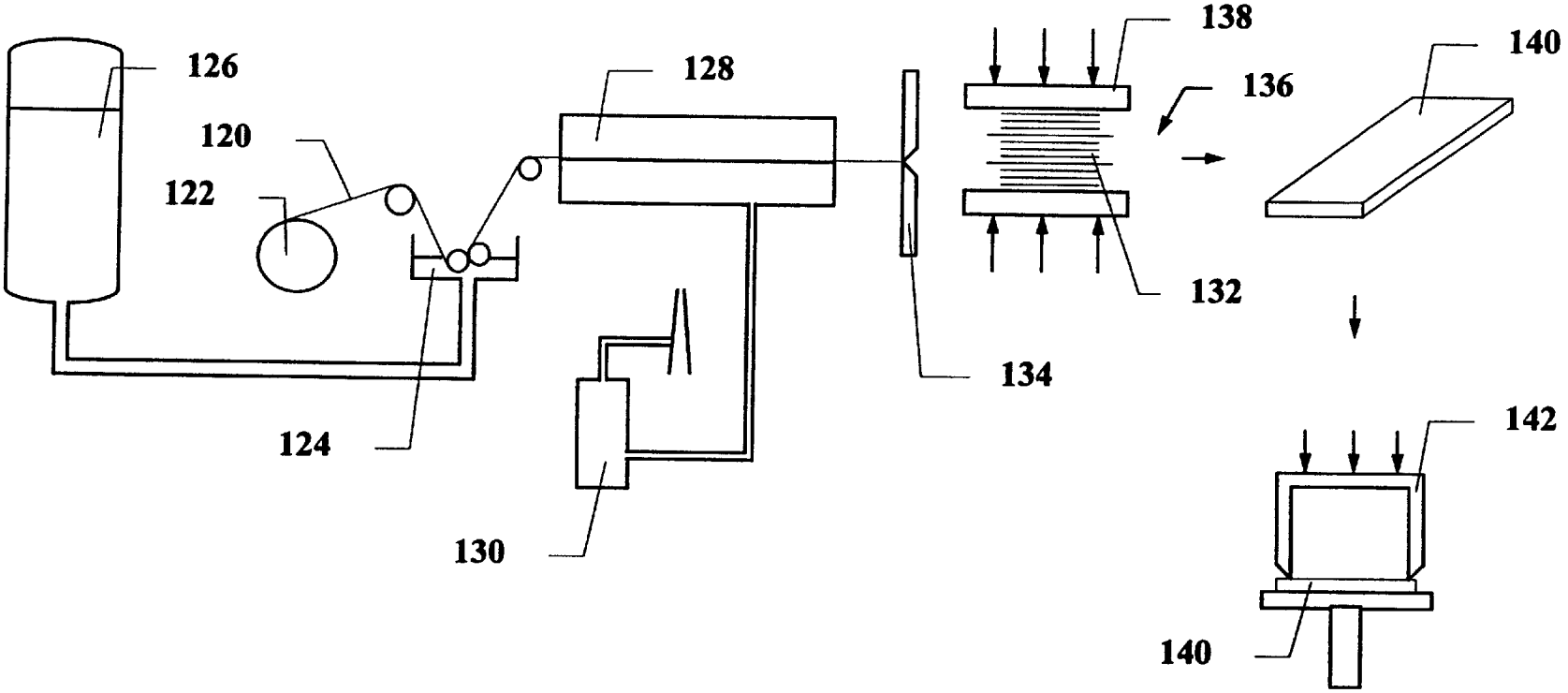
FIG. 7 schematically represents a manufacturing process of a side wall of a chamber according to FIG. 3.

The composite structure 100 can be obtained according to a process schematically represented in FIG. 7. A strip 120 of polyamide fabric coming from a roll 122 runs in a continuous flow in a resin bath 124 fed by a tank 126, then in a heating tunnel 128 connected to a boiler 130. Due to the effect of the heat, the resin melts then hardens by a reticulated polymerization process. On output from the tunnel 128, the coated fabric is cut into sheets 132 by a cutting press 134. On output, the sheets 132 are stacked. The stack 136 is run through a press 138 under high pressure, at a temperature of about 140° C. to 210° C., so as to cause interlaminary flow of the resin enabling adhesion between the sheets 132 to take place. The plates 140 obtained are then cut in a second cutting press 142 in order to give them the final shape in accordance with their use.

The results obtained with this type of structure are very advantageous. When a break occurs on a short-circuit, the melamine formaldehyde resin erodes and lets the polyamide strengthening fabric become apparent. This fabric gives off in particular hydrogen which allows formation of a gaseous film protecting the surface directly exposed to the arc. Consequently, the adherence of the molten particles is very greatly reduced. The electrical withstand properties remain optimal throughout the exposure phase of the walls to the arc.

After the arc has been extinguished, the heat stored in the metallic strips, i.e. about one third of the breaking energy, is dissipated, in particular by diffusion through the side walls, thus increasing their temperature. In this phase, the thermosetting resin ensures the mechanical strength of the wall, as the polyamide is for its part a thermoplastic material, reversible in liquid above 300° C.

Due to the simultaneous volatilization of the polyamide and of the melamine, there is no dielectric weak point creation, in particular at the level of the cutouts 70 of the structure.

Figure 8:
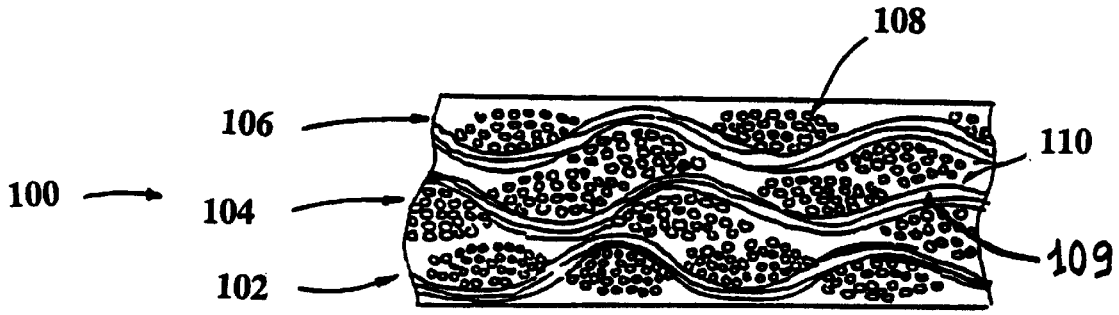
FIG. 8 schematically represents a transverse cross-section of a side wall according to a second embodiment of a chamber according to FIG. 3.

FIG. 8 represents a transverse cross-section of a cheek according to a second embodiment of the invention, which only differs from the previous embodiment in the smaller thickness of the resin layer 100 separating two successive layers of cloth. The mechanical and dielectric characteristics of this cheek are more homogeneous. The performance obtained is of the same order as that of the previous example. This illustrates the doubtlessly preponderant importance of the resin coating the wires of the polyamide fabric and impregnating the fabric with respect to that situated farther away from the polyamide wires between two layers of fabric.

The invention is naturally not limited to the above embodiment. The armor of the fabric can be simple (cloth armor) or complex. The different sheets constituting the different layers of the structure can be stacked in the same direction or alternatively in different directions, so as to obtain particular mechanical characteristics. The structure can, in addition to one or more layers composed of melamine reinforced with polyamide fabric, also comprise layers of different natures. Coating of the polyamide fabric fibers can be partial or full. The thermosetting resin can usefully contain fire-proofing elements such as inorganic charge generating material which may be hydrated or not (magnesium hydroxides, zinc borate . . . ), nitrogenous compounds, phosphoreted compounds, organo-halogenated compounds or organo-phosphoreted compounds. The number of layers is variable according to requirements. Good results are obtained with a structure with an overall thickness of 1 to 3 mm comprising 2 to 20 layers.

Likewise the invention is not limited to the particular type of chamber described in the embodiment. In particular, the separators may be of any shape and arrangement. The chamber may or may not be removable with respect to the case which contains said chamber.

Finally, although the invention has been described with reference to a particular circuit breaker with two pole compartments per phase connected to one another by an opening, the invention is not limited to this type of switchgear apparatus. It is naturally applicable to any type switchgear apparatus using arc extinguishing chambers. The breaking resistance characteristics of the side walls of the chambers according to the invention, in particular at the level of the edges exposed to the arc, avoid any particular treatment of these edges from being required. However, the vocation of the invention is also to apply to chambers whose walls do not necessarily have edges exposed to the arc.

What is claimed is:

1. An electrical arc extinguishing chamber designed to be placed facing separable contact means of a switchgear apparatus and to extinguish the arc generated by separation of said contact means, comprising:

two side walls facing one another, each side wall comprising a stratified composite structure including at least a first layer comprising a woven polyamide fabric impregnated with a thermosetting resin, and a second layer superposed on said first layer and comprising a woven polyamide fabric impregnated with said thermosetting resin, a plurality of spaced apart plates, arranged between the side walls and secured by the side walls.

2. The electrical arc extinguishing chamber according to claim 1, wherein the thermo-setting resin is of the type obtained by condensation of formaldehyde with melamine.

3. The electrical arc extinguishing chamber according to claim 2, wherein the charge comprises magnesium hydroxides.

4. The electrical arc extinguishing chamber according to claim 2, wherein the charge comprises zinc borate.

5. The electrical arc extinguishing chamber according to claim 2, wherein the charge comprises magnesium hydroxide and zinc borate.

6. The electrical arc extinguishing chamber according to claim 1, wherein the thermosetting resin contains a charge of fire-proofing element selected from the group consisting of nitrogenous compounds, phosphorated compounds, organo-halogenated compounds or organo-phosphorated compounds.

7. A switchgear apparatus comprising:

at least one pole comprising at least one pair of contact means, one at least of the contact means movable whereby the pair of contact means takes an open position and a closed position, and an arc extinguishing chamber comprising two side walls facing one another, each wall comprising a stratified composition structure including at least a first layer comprising a woven polyamide fabric impregnated with a thermosetting resin, and a second layer superposed on said first layer and comprising a woven polyamide fabric impregnated with said thermosetting resin, an operating mechanism kinematically linked to the pair of contact means of each pole and able to separate the pairs of contact means of each pole by making the pair move from a closed position to an open position.

8. The switchgear apparatus according to claim 7, wherein the thermosetting resin is of the type obtained by condensation of formaldehyde with melamine.

9. The switchgear apparatus according to claim 7, wherein the thermosetting resin contains a charge of fire-proofing element selected from the group consisting of nitrogenous compounds, phosphorated compounds, organo-halogenated compounds or organo-phosphorated compounds.

10. The switchgear apparatus of claim 7, wherein the charge comprises magnesium hydroxides.

11. The switchgear apparatus of claim 7, wherein the charge comprises zinc borate.

12. The switchgear apparatus of claim 7, wherein the charge comprises magnesium hydroxides and zinc borate.

* * * * *